United States Patent [19]

Nickles

[11] 4,421,139

[45] Dec. 20, 1983

[54] PLUG FOR OFFSHORE PLATFORMS AND THE LIKE

[75] Inventor: R. Benton Nickles, Duncan, Okla.

[73] Assignee: Halliburton Company, Duncan, Okla.

[21] Appl. No.: 266,762

[22] Filed: May 26, 1981

[51] Int. Cl.[3] ..... E02B 17/00

[52] U.S. Cl. ..... 138/89; 166/188; 405/227

[58] Field of Search ..... 138/89; 405/224, 225, 405/226, 227; 166/135, 181, 188, 192

[56] References Cited

U.S. PATENT DOCUMENTS

| | | | |
|---|---|---|---|
| 679,393 | 7/1901 | McPherson | 166/135 |
| 838,093 | 12/1906 | Emmons | 138/89 |
| 2,241,526 | 5/1941 | Rosenkranz | 138/90 |
| 2,256,775 | 9/1941 | Hubbell | 138/89 |
| 2,465,727 | 3/1949 | Jensen | 138/89 |
| 2,665,875 | 1/1954 | MacGregor | 138/89 |
| 2,670,799 | 3/1954 | Dobbs | 138/89 |
| 2,683,492 | 7/1954 | Baker | 166/217 |
| 2,776,015 | 1/1957 | Bielstein | 138/89 |
| 2,810,401 | 10/1957 | Stansbury | 138/89 |
| 2,857,972 | 10/1958 | Baker | 166/188 |
| 2,970,651 | 2/1961 | Roberts | 166/212 |
| 3,042,116 | 7/1962 | Sharp et al. | 138/89 |
| 3,048,998 | 8/1962 | Gilreath | 166/133 |
| 3,135,417 | 6/1964 | Gardiner et al. | 220/316 |
| 3,155,116 | 11/1964 | Ver Noov | 138/89 |
| 3,161,037 | 12/1964 | Lagerquist | 138/89 |
| 3,162,505 | 12/1964 | Hall | 73/40.5 |
| 3,236,309 | 2/1966 | Conrad | 166/120 |
| 3,250,331 | 5/1966 | Boyle | 166/133 |
| 3,353,566 | 11/1967 | Cepkauskas et al. | 138/89 |
| 3,434,293 | 3/1969 | Brown | 405/207 |
| 3,577,737 | 5/1971 | Burleson | 138/89 |
| 3,593,749 | 7/1971 | Reardon | 138/93 |
| 3,593,784 | 7/1971 | Brown | 166/145 |
| 3,613,381 | 10/1971 | Cox | 405/206 |
| 3,746,026 | 7/1973 | Herring | 138/89 |
| 3,747,541 | 7/1973 | Reese | 138/89 |
| 3,884,261 | 5/1975 | Clynch | 138/93 |
| 3,978,678 | 9/1976 | Duncan et al. | 138/89 |
| 3,978,892 | 9/1976 | Scodino | 138/89 |
| 4,050,731 | 9/1977 | Coone et al. | 294/86.24 |
| 4,142,371 | 3/1979 | Mayfield et al. | 405/224 |
| 4,160,612 | 7/1979 | Britton et al. | 138/89 |
| 4,178,967 | 12/1979 | Streich | 138/89 |
| 4,184,515 | 1/1980 | Streich et al. | 138/89 |
| 4,215,951 | 8/1980 | Knox | 138/89 |
| 4,262,702 | 4/1981 | Streich | 138/89 |

FOREIGN PATENT DOCUMENTS

| | | |
|---|---|---|
| 11179 | of 1896 | United Kingdom . |
| 1021256 | 3/1966 | United Kingdom . |
| 1554894 | 10/1975 | United Kingdom . |

*Primary Examiner*—John W. Shepperd
*Attorney, Agent, or Firm*—James R. Duzan

[57] ABSTRACT

An improved reusable plug for sealing hollow cylindrical members, such as the jacket legs, pile sleeves, piling, conductor pipes or other similar members of offshore structures, wherein the plug includes an improved packer mandrel and improved dog locking sleeve assembly.

6 Claims, 1 Drawing Figure

PLUG FOR OFFSHORE PLATFORMS AND THE LIKE

This invention relates to an improved reusable plug for sealing hollow cylindrical members, in particular, the jacket legs, pile sleeves, pilings, conductor pipes, or other similar members of offshore structures.

BACKGROUND OF THE INVENTION

Typically, when constructed, an offshore platform has the jacket legs, pile sleeves, and conductor pipes sealed to prevent water leakage therein to facilitate towing operations and platform erection. With the jacket legs sealed against water leakage, the offshore platform may either be directly towed to the desired erection site or placed on barges and towed to the erection site. After being towed or transported by means of barges to the erection site, the offshore platform is positioned on the sea bottom by the controlled flooding of one or more of the jacket legs.

Sometimes, it is desirable to pre-install the piles, which are used to anchor the offshore platform to the floor of the body of water in which the platform is to be installed, in the jacket legs of the platform before the platform is transported to the erection site. When the piles are pre-installed in the jacket legs, they must also be sealed against water leakage thereinto.

One type of plug used to seal jacket legs, piles and conductor pipes of an offshore platform is described in U.S. Pat. No. 4,142,371. The plug comprises a steel cup retained within a cylindrical housing the same diameter as the jacket leg or member and is welded therein. The steel cup is retained within the cylindrical housing by means of a molded elastomeric member which has a portion of the cup retrieving cable spirally wrapped within the elastomeric member. To retrieve the cup from the jacket leg or member, a force is applied to the free end of the cable at the top of the jacket leg or member which, in turn, progressively rips the molded elastomeric member apart thereby freeing the steel cup to move upwardly in the jacket leg or member. However, since the plug and the housing must be installed in the jacket leg or member during the construction phase of the platform, any changes subsequent to the installation of the plug and housing which would affect the platform's weight distribution are undesirable to make because they would require relocation of the plug and housing in the jacket leg or member. Also, once the steel cup is removed from the jacket leg or member, since the cable embedded in the elastomeric material merely rips the elastomeric material apart, a residue of elastomeric material remains in the jacket leg or member which usually must be removed therefrom.

Another type of plug used to seal the jacket legs or other members of an offshore platform is an inflatable type plug having a plurality of slips or grippers engaging the jacket leg or member wall anchoring the plug in position by means of an inflatable member therebehind which also seals the interior of the jacket leg or member. An inflatable plug of this type has the disadvantages of the inflatable member rupturing or loosing inflation pressure, the inflation pressure may not be great enough to cause the slips or grippers to firmly engage the jacket leg or member to hold the plug in position, added equipment must be installed on the platform during towing operations to assure inflation pressure of the inflatable member is maintained and the jacket leg or member may be damaged by the slips or grippers engaged by the same.

Yet another type plug used to seal the jacket leg of an offshore platform is disclosed in U.S. Pat. No. 4,160,612. This type of plug is an inflatable type plug having adjustable locking dogs which engage an annular groove in a locking ring installed on the inside of the jacket leg. An inflatable plug of this type has the disadvantages of requiring a complex adjustment linkage for the locking dogs, the inflatable member may rupture or loose pressure, added equipment must be present to insure the inflation pressure of the inflatable packer is maintained, and a locking ring must be installed inside the jacket leg which may be particularly difficult if the locking ring is not concentric with the jacket leg.

Still another type plug used to seal the jacket leg of an offshore platform is disclosed in U.S. Pat. No. 4,215,951. This type of plug utilizes either a compression set packer element or cup type sealing element and is held in engagement with the interior of an annular member by means of locking dogs engaging locking rings on the interior of the annular member. This type of plug has the disadvantage of utilizing a flat circular plug to seal the interior thereof causing the plug to be excessively heavy for large pressures and sizes and has a dog locking sleeve which may cock and bind during release if the plug is not manufactured carefully.

Still yet another type of plug, a conductor pipe plug, is illustrated in U.S. Pat. No. 4,184,515. This type of plug comprises central body member having elastomeric sealing means and pressure equalization means thereon installed in a cylindrical housing secured to a conductor pipe. The central body member of the plug is retained within the cylindrical housing by means of a plurality of shear pins. While this type of plug is simple to construct and use, for platforms installed in large depths of water the strength of the shear pins required to retain the central body member in the cylindrical housing becomes large requiring very large diameters of cables to be required connecting with the plug for removal from the conductor pipe.

Another type of conductor pipe plug is disclosed in U.S. Pat. No. 4,178,967. This type of plug comprises a central body member having elastomeric sealing means, pressure equalization means, and retractable release means thereon installed in a cylindrical housing secured to conductor pipe. The central body member of the plug is retained within the cylindrical housing by the retractable release means engaging an annular groove in the cylindrical housing. While this plug is simple to manufacture and use, since the retractable release means comprises a plurality of rod like members, each having the outer end thereof engaging the annular groove in the cylindrical housing, for platforms installed in very large depths of water the forces acting on the plug may be so great as to cause the ends of the retractable release means engaging the annular groove in the cylindrical housing to deform the annular groove locally, thereby making it difficult to release the plug during removal operations.

A further type of conductor pipe plug is described in U.S. Pat. No. 4,262,702. This type of plug comprises a plug housing and plug body including a sealing mandrel which may contain either a compression set type packer member, sealing cup type sealing member, or inflatable type sealing member thereon, locking dogs, dog locking sleeve and a pressure equalization plug abutting the dog locking sleeve means retaining the locking dogs engaging the plug housing when the plug body is installed therein.

Further types of improved conductor pipe, jacket leg or pile sleeve plugs are described in U.S. patent application Ser. Nos. 194,185 and 194,316, filed Oct. 6, 1980 and assigned to the assignee of the present invention. The improved plugs described therein have either a dog locking sleeve assembly having increased lengths, specific contours on the exterior thereof, or extensions thereon to help eliminate cocking and binding of the dog locking sleeve assemblies within the plug bodies when they are actuated. However, such improved plugs require plug bodies having increased lengths thereby increasing the cost and weight thereof over prior art plugs.

Another type plug is described in U.S. Pat. No. 2,776,015 and is used in plugging the tubing string in an oil or gas well. This plug comprises a plug body retained in tubing plug sub connected in a tubing string. The plug is retained in the sub by means of a plurality of spheres which engage an annular recess in the sub. Under high pressures, the spheres will be deformed into the annular recess in the sub making it difficult or impossible to release the plug from the sub. Also, the plug lacks a means of indicating when it is allowing fluid flow therethrough or is being released from the sub making it difficult to use.

Another yet different type plug used in offshore platforms is described in U.S. Pat. No. 3,577,737. This plug comprises a compressible rubber member retained between two discs having a central axially disposed rod running therethrough and an upper block assembly slidably receiving the rod therein having a plurality of retractable pins retaining the plug within the cylindrical member in which it is installed on the offshore platform. This type of plug does not have a pressure equalization means and requires a large amount of elastomeric material for the compressible rubber member.

STATEMENT OF THE INVENTION

The invention is directed to a plug comprising a plug body having an improved packer mandrel and an improved dog locking sleeve assembly.

DESCRIPTION OF THE INVENTION

Figure 1:
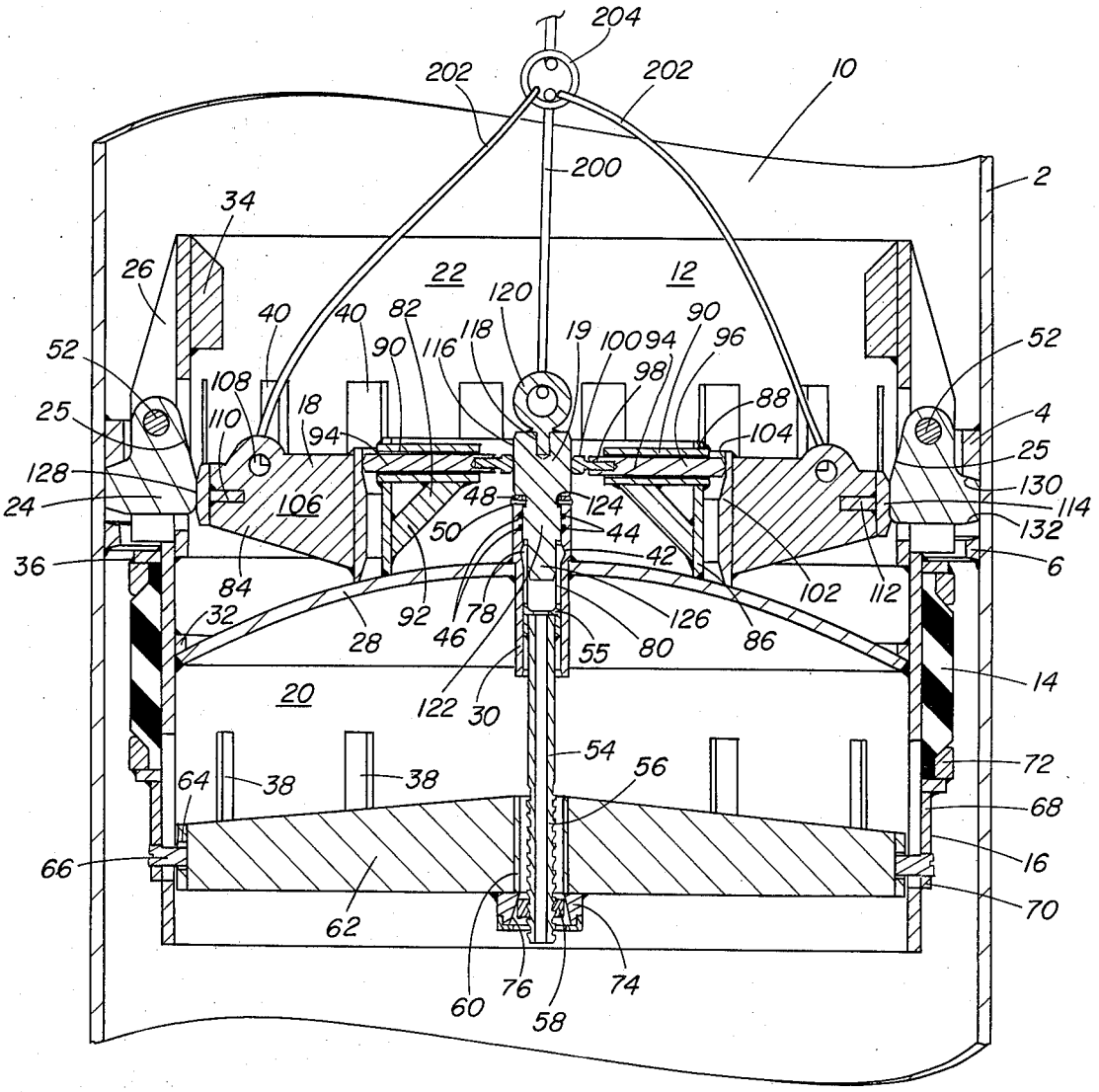
FIG. 1 is a cross-sectional view of the invention installed in a cylindrical member having a compression type packer thereon in its uncompressed state.

Referring to FIG. 1, the present invention is shown in its preferred embodiment. The plug 10 of the present invention is shown installed in a cylindrical member 2, such as an offshore platform leg, pile sleeve, conductor pipe, etc., having an upper plug body retaining ring 4 and lower plug body retaining ring 6 installed therein.

The plug body 10 comprises a packer mandrel assembly 12, packer member 14, packer setting sleeve assembly 16, dog locking sleeve assembly 18 and pressure equalization plug 19.

The packer mandrel assembly 12 comprises lower cylindrical sleeve 20, upper cylindrical sleeve 22, locking dogs 24, locking dog supports 26, dished plug 28 having collet sleeve 30 retained therein, lower mandrel reinforcing ring 32, retaining blocks 34 and packer member retaining assembly 36.

The lower cylindrical sleeve 20 comprises a cylindrical annular member having a plurality of elongated slots 38 therein, having the upper packer member retaining assembly 36 secured to the exterior thereof at any suitable position and having dished plug 28 and lower mandrel reinforcing ring 32 secured to the interior thereof at any suitable position. The upper packer member retaining assembly 36 may be of any suitable configuration to retain one end of the packer member 14 from movement when the packer member 14 is installed on the packer mandrel 12.

The collet sleeve 30 retained within dished plug 28 comprises an elongated cylindrical annular member having an annular recess therein, having annular seal cavities 44 having, in turn, seal means 46 therein which may be any suitable type elastomeric seal means, and having a plurality of apertures 48 having, in turn, shear pins 50 installed therein.

The dished plug 28 may be of any suitable spherical or elliptical cross-sectional configuration. By utilizing a dished plug 28 rather than a flat plug the dished plug 28 may be constructed of thinner material thickness thereby reducing the weight and thereby the cost of the plug body 10.

The upper cylindrical sleeve 22 comprises a cylindrical annular member having a plurality of elongated slots 40 therein, having locking dog supports 26 secured to the exterior thereof, and having the retaining blocks 34 secured to the interior thereof at any suitable position.

The locking dogs 24 are rotatably mounted on pins 52 which extend between adjacent locking dog supports 26 being secured thereto and rotatably extend through slots 40 in the upper cylindrical sleeve 22. Each locking dog 24 is formed having an inwardly extending angular surface 25 on the interior thereof which terminates in vertical surface 128 which in turn, mates with dog locking ring 114. Each locking dog 24 is further formed with angular faces 130 and 132 on the exterior portion thereof which mate with upper plug body retaining ring 4 and lower plug body retaining ring 6 respectively.

The packer member 14 comprises any suitable compression set elastomeric packer member.

The packer setting sleeve assembly 16 comprises packer setting mandrel 54 having collet member 55 secured to one end thereof, having threaded portion 56 thereon and having threaded fastener 58 secured to the other end thereof, packer setting sleeve 60, a plurality of radial spokes 62, cylindrical annular rim 64 having a plurality of apertures 66 therein having, in turn, a plurality of pins secured therein extending through slots 38 in the lower cylindrical sleeve 22, cylindrical annular packer setting sleeve 68 having apertures 70 therein, each receiving a portion of pin 66 therein, and having lower packer member retaining assembly 72 secured thereto, and packer setting sleeve bushing 74. The lower packer member retaining assembly 72 may be of any suitable configuration to retain one end of the packer member 14.

The packer setting sleeve bushing 74 comprises an annular cylindrical member having a conical bore 76 therein which abuts the exterior of threaded fastener 58 secured to one end of packer setting mandrel 54.

The collet member 55 comprises a cylindrical annular member having one end secured to the packer setting mandrel 54 while the other end thereof is releasably secured having a portion of the enlarged ends 78 of spring collet fingers 80 retained within annular recess 42 of collet sleeve 30.

The dog locking sleeve assembly 18 comprises a stationary portion 82 and movable portion 84.

The stationary portion 82 comprises cylindrical annular sleeve 86 having one end thereof secured to dished head 28, having a plurality of apertures 88 therein receiving a one end portion of a plurality of guides 90 therein, the other end portion secured by means of supports 92 to the sleeve 86, and a plurality of movable adjustable pins 94 slidably received within guides 90.

The adjustable pins 94 comprise a pin body 96 having a threaded aperture 98 in one end thereof receiving a portion of thread member 100 therein.

The movable portion 84 comprises cylindrical annular member 102 having cylindrical, conical, cylindrical bore 104 therethrough, a plurality of radial supports 106 extending from the exterior surface of member 102, each having one end thereof secured to member 102, having aperture 108 therein and having slot 110 in the other end thereof, reinforcing ring 112 retained within slot 110 of the radial supports 106 being secured thereto, and dog locking ring 114 being secured to the end portion of radial supports 106 and reinforcing ring 112.

The pressure equalization plug 19 comprises an elongated cylindrical plug having a first portion 116 having an aperture 118 therein receiving a portion of eyebolt 120 therein, a second reduced diameter portion 122 having annular recess 124 therein receiving a portion of shear pins 50 therein when the plug 19 is installed in collet sleeve 30 and third reduced diameter portion 126 which engages the interior of enlarged ends 78 of collet spring fingers 80 to retain the ends 78 within annular recess 42 in the collet sleeve 30 when the plug 19 is installed therein.

OPERATION OF THE INVENTION

To install the plug body 10 in a cylindrical member 2, the upper 4 and lower 6 plug body retaining means are secured in position in the cylindrical member 2. Subsequently, the plug body 10 is moved into position within the cylindrical member 2 having the locking dogs 24 being retained between the plug body retaining means 4 and 6. To secure the plug body 10 in position in the cylindrical member 2 the dog locking sleeve assembly 18 is positioned within the upper cylindrical sleeve 22 of the packer mandrel assembly 12 having the locking ring 114 of the dog locking sleeve assembly 18 abutting interior surface 128 of the locking dogs 24, the adjustable pins 94 are moved outwardly until their ends engage the upper cylindrical portion of the bore 104 of cylindrical annular member 102 of the movable portion 84 of the dog locking sleeve assembly 18, the pressure equalization plug 19 is inserted into collet sleeve 30 having the third portion 126 thereof engaging the enlarged ends 78 of collet spring fingers 80 to retain the ends 78 within annular recess 42 in the collet sleeve 30 as well as the second portion 122 sealingly engaging seal means 46 in the annular recesses 44 of the collet sleeve 30 and the shear pins 50 are installed in the apertures 49 in the collet sleeve 30, each having a portion thereof extending into annular recess 124 of the pressure equalization plug 19 to releasably retain the pressure equalization plug 19 within the collet sleeve 30. At this time, the plug body 10 is prevented from axial movement within cylindrical member 2 by plug body retaining means 4 and 6 engaging locking dogs 24 of the plug body 10, the locking dogs 24 are prevented from movement by dog locking sleeve assembly 18, and the dog locking sleeve assembly 18 is prevented from movement by the adjustable pins 94, each having one end abutting the exterior of pressure equalization plug 19 while the other end abuts cylindrical portion of bore 104 being prevented from inward movement along conical portion of bore 104 by abutting the exterior of the first portion 116 of the plug 19.

To compress the packer member 14 into engagement with the cylindrical member 2 a hydraulic jack or other device is attached to the threaded end portion 56 of packer setting mandrel 54 to apply sufficient force to the packer setting sleeve assembly 16 via bushing 74 to compress the packer member 14 to seal the annulus between the plug body 10 and cylindrical member 2. During the packer member setting process the packer member 14 is compressed between upper packer member retaining assembly 36 and lower packer member retaining assembly 72. As the packer member 14 is compressed to seal the annulus between the plug body 10 and cylindrical member 2, the threaded fastener 58 is advanced along threaded portion 56 of packer setting mandrel 54 to abut conical bore 76 of packer setting sleeve bushing 74 at which time the jack or other device may be removed from the threaded portion 56. The packer setting mandrel 54 is prevented from axial movement by being secured at its upper end by means of enlarged ends 78 of collet member 55 being trapped in annular recess 42 of collet sleeve 30 by the third portion 126 of pressure equalization plug 19.

It should be noted that any forces applied from below the plug body 10 will compress the packer member 14 tighter in the annulus between the plug body 10 and cylindrical member 2, that the axial loading of the plug body 10 is carried by plug body retaining means 4 and 6, and that any fluid entering the collet sleeve 30 is prevented from flowing therethrough by pressure equalization plug 19 sealingly engaging the interior of the collet sleeve 30.

To remove the plug body 10 from the cylindrical member 2 after the packer member 14 has been compressed to seal the annulus between the plug body 10 and cylindrical member 2, initially, a force is applied to a line 200 secured to eyebolt 120 attached to pressure equalization plug 19 to shear threaded shear pins 50 to allow the removal of the pressure equalization plug 19 from the collet sleeve 30 thereby allowing the collet 55 to be released therefrom which allows packer member 14 to relax and disengage the interior of cylindrical member 2 and allow fluid to flow through collet sleeve 30 and around the packer member 14 as it relaxes to equalize any fluid pressure differential across the plug body 10. At this point, although the pressure equalization plug 19 has been removed from the collet sleeve 30, since line 200 is a shorter length than lines 202, the dog locking sleeve assembly 18 remains in engagement with locking dogs 24 thereby maintaining the locking dogs 24 in engagement with plug body retaining means 4 and 6. After any fluid pressure differential has been equalized across plug body 10 and after the packer member 14 has had sufficient time to relax, disengage the cylindrical member 2 and return to a diameter which will allow the plug body 10 to pass through the plug body retaining means 4 and 6, a second force is applied to lines 202 connected to ring 204 to cause the dog locking sleeve assembly 18 to move within second cylindrical member 22 of packer mandrel 12 until it abuts retaining blocks 34 at which time the locking dogs 24 are free to pivot about mounting pins 52 inwardly through slots 40 and disengage plug body retaining means 4 and 6 thereby allowing the plug body 10 to be moved through the cylindrical member 2 and be removed therefrom.

It should be noted that by forming each locking dog 24 having an inwardly extending angular face 25 terminating in a vertical surface 128 on the interior thereof, any cocking and binding problems of the dog locking sleeve assembly 18 within the packer mandrel 12 caused by uneven pulling forces on the dog locking sleeve assembly 18 which tend to cause cocking and binding of the dog locking sleeve assembly 18 within the packer mandrel 12 have been eliminated. By abutting dog locking ring 114 only on vertical surface 128 of each locking dog 24 and providing each locking dog 24 with an inwardly extending angular face 25 clearance is provided between the dog locking sleeve assembly 18 and the interior of the packer mandrel 12 to allow movement therebetween without requiring the use of dog locking sleeve assemblies which are of excessive length or dog locking sleeve assemblies which have guides thereon thereby allowing the plug body 10 of the present invention to be of shorter length, be of lesser weight and be of lower cost than a comparable prior art plug body.

Also, by utilizing a dog locking sleeve assembly 18 having a stationary portion 82 secured to the dished plug 28 of the packer mandrel 12 and a movable portion 84 the manufacturing cost of the dog locking sleeve assembly 18 is reduced. The manufacturing cost of the dog locking sleeve assembly is reduced over the prior art plug bodies since shorter adjustable pins 94 may be utilized and cylindrical, conical, cylindrical bore 104 is of a smaller diameter than in the prior art thereby reducing machining costs.

Having thus described my invention, I claim:

1. A removable plug for temporarily sealing the interior of an annular member to prevent the flow of fluid therethrough, said removable plug comprising:

plug body means adapted to be disposed within said annular member, the plug body means comprising:

packer mandrel means having a plurality of apertures therein and having a plug therein for preventing the flow of said fluid therethrough, the plug having a sleeve therein;

packer member means located on the packer mandrel means for sealingly engaging the interior of said annular member;

packer setting sleeve means located on the packer mandrel means for compressing the packer member means into sealing engagement with the interior of said annular member;

locking dog means pivotally mounted on the packer mandrel means for retaining said plug from axial movement when installed in said annular member, the locking dog means comprising:

a plurality of members pivotally mounted on the packer mandrel means, each member having a portion of the exterior thereof adapted to engage a portion of the interior of said annular member when said plug is installed therein, having a portion of the interior thereof including an angular inwardly extending surface terminating in a vertical surface and being rotatable through an aperture of the plurality of apertures in the packer mandrel means;

pressure equalization means releasably secured within the sleeve of the packer mandrel means for allowing the flow of said fluid through said plug when said plug is installed in said annular member thereby allowing the pressure of said fluid to substantially equalize in said annular member and across said plug before the removal of said plug from said annular member; and dog locking sleeve assembly means slidable within the packer mandrel means between a first position wherein the locking dog means abut a portion of the exterior surface of the dog locking sleeve assembly means thereby preventing rotation of the locking dog means through the apertures in the packer mandrel means and a second position wherein the locking dog means are free to rotate through the apertures in the packer mandrel means thereby disengaging the interior of said annular member when said plug is installed therein to allow the removal of said plug from said annular member, the dog locking sleeve assembly means comprising:

stationary portion means having a portion thereof secured to the plug of the packer mandrel means and having movable pin means therein having one end thereof adapted to engage the exterior of the pressure equalization plug means when the pressure equalization plug means is installed in the sleeve of the packer mandrel means; and movable portion means including annular member means having a bore therethrough adapted to engage the other end of the movable pin means of the stationary portion means when the pressure equalization plug means is installed in the sleeve of the packer mandrel means to retain the dog locking sleeve means in a first position in the packer mandrel means having the dog locking sleeve means engaging the locking dog means, radial support means having one end thereof secured to the annular member means, and dog locking ring means secured to the other end of the radial support means and having the exterior thereof adapted to engage the vertical surface of the locking dog means when dog locking sleeve means is in a first position in the packer mandrel means and to disengage the locking dog means is in a second position within the packer mandrel means thereby allowing the locking dog means to rotate through the apertures in the packer mandrel means.

2. The removable plug of claim 1 wherein the plug of the packer mandrel means comprises a dished plug.

3. The removable plug of claim 1 wherein the bore in the movable portion means of the dog locking sleeve assembly means comprises a bore having a cylindrical portion, conical portion, and cylindrical portion.

4. The removable plug of claim 1 wherein the movable portion means of the dog locking sleeve assembly means further includes:

reinforcing ring means secured to the dog locking ring means and the radial support means of the movable portion means.

5. A removable plug for temporarily sealing the interior of an annular member to prevent the flow of fluid therethrough, said removable plug comprising:

plug body means adapted to be disposed within said annular member, the plug body means comprising:

packer mandrel means having a plurality of apertures therein and having a dished plug therein for preventing the flow of said fluid therethrough, the plug having a sleeve therein;

packer member means located on the packer mandrel means for sealingly engaging the interior of said annular member;

packer setting sleeve means located on the packer mandrel means for compressing the packer member means into sealing engagement with the interior of said annular member;

locking dog means pivotally mounted on the packer mandrel means for retaining said plug from axial movement when installed in said annular member, the locking dog means comprising:

a plurality of members pivotally mounted on the packer mandrel means, each member having a portion of the exterior thereof adapted to engage a portion of the interior of said annular member when said plug is installed therein, having a portion of the interior thereof including an angular inwardly extending surface terminating in a vertical surface and being rotatable through an aperture of the plurality of apertures in the packer mandrel means;

pressure equalization means releasably secured within the sleeve of the packer mandrel means for allowing the flow of said fluid through said plug when said plug is installed in said annular member thereby allowing the pressure of said fluid to substantially equalize in said annular member and across said plug before the removal of said plug from said annular member; and dog locking sleeve assembly means slidable within the packer mandrel means between a first position wherein the locking dog means abut a portion of the exterior surface of the dog locking sleeve assembly means thereby preventing rotation of the locking dog means through the apertures in the packer mandrel means and a second position wherein the locking dog means are free to rotate through the apertures in the packer mandrel means thereby disengaging the interior of said annular member when said plug is installed therein to allow the removal of said plug from said annular member, the dog locking sleeve assembly means comprising:

stationary portion means having a portion thereof secured to the plug of the packer mandrel means and having movable pin means therein having one end thereof adapted to engage the exterior of the pressure equalization plug means when the pressure equalization plug means is installed in the sleeve of the packer mandrel means; and movable portion means including annular member means having a bore therethrough adapted to engage the other end of the movable pin means of the stationary portion means when the pressure equalization plug means is installed in the sleeve of the packer mandrel means to retain the dog locking sleeve means in a first position in the packer mandrel means having the dog locking sleeve means engaging the locking dog means, radial support means having one end thereof secured to the annular member means, reinforcing ring means secured to the radial support means and dog locking ring means secured to the radial support means and the reinforcing ring means and having the exterior thereof adapted to engage the vertical surface of the locking dog means when dog locking sleeve means is in a first position in the packer mandrel means and to disengage the locking dog means is in a second position within the packer mandrel means thereby allowing the locking dog means to rotate through the apertures in the packer mandrel means.

6. The removable plug of claim 6 wherein the bore in the movable portion means of the dog locking sleeve assembly means comprises a bore having a cylindrical portion, conical portion, and cylindrical portion.

* * * * *

UNITED STATES PATENT AND TRADEMARK OFFICE

CERTIFICATE OF CORRECTION

PATENT NO. : 4,421,139

DATED : Dec. 20, 1983

INVENTOR(S) : R. Benton Nickles

It is certified that error appears in the above-identified patent and that said Letters Patent is hereby corrected as shown below:

In column 5, line 43, following the words "having the" insert the word --dog--.

Signed and Sealed this

*Eighth* Day of *May 1984*

[SEAL]

*Attest:*

GERALD J. MOSSINGHOFF

*Attesting Officer*

*Commissioner of Patents and Trademarks*